US007466947B2

(12) United States Patent
Zemba

(10) Patent No.: US 7,466,947 B2
(45) Date of Patent: Dec. 16, 2008

(54) APPARATUS FOR FOMING IMAGES

(75) Inventor: Hideki Zemba, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 240 days.

(21) Appl. No.: 11/372,142

(22) Filed: Mar. 10, 2006

(65) Prior Publication Data

US 2006/0204285 A1 Sep. 14, 2006

(30) Foreign Application Priority Data

Mar. 10, 2005 (JP) ..... 2005-067027

(51) Int. Cl.
*G03G 15/09* (2006.01)

(52) U.S. Cl. ..... 399/276

(58) Field of Classification Search ..... 399/267, 399/275, 276
See application file for complete search history.

(56) References Cited

U.S. PATENT DOCUMENTS

| | | | | |
|---|---|---|---|---|
| 4,018,187 | A * | 4/1977 | Abbott et al. | 399/276 |
| 4,331,101 | A * | 5/1982 | Muller et al. | 399/276 |
| 4,575,220 | A * | 3/1986 | Sakamoto et al. | 399/267 |
| 4,786,936 | A * | 11/1988 | Ikegawa et al. | 399/276 |
| 4,836,136 | A * | 6/1989 | Natsuhara | 399/276 |
| 5,153,376 | A * | 10/1992 | Tomita | 399/276 |
| 6,085,062 | A | 7/2000 | Mizuishi et al. | |
| 6,128,449 | A | 10/2000 | Zenba et al. | |
| 6,144,811 | A | 11/2000 | Ohori et al. | |
| 6,144,822 | A | 11/2000 | Yamaguchi et al. | |
| 6,148,161 | A | 11/2000 | Usui et al. | |
| 6,160,969 | A | 12/2000 | Ishigaki et al. | |
| 6,266,501 | B1 | 7/2001 | Mizuishi et al. | |
| 6,628,903 | B1 | 9/2003 | Ohori et al. | |
| 6,898,383 | B2 | 5/2005 | Ohori et al. | |
| 6,975,830 | B2 | 12/2005 | Murakami et al. | |
| 6,993,267 | B2 | 1/2006 | Yoshiyuki et al. | |
| 6,993,281 | B2 | 1/2006 | Yoshizawa et al. | |
| 2004/0042822 | A1 | 3/2004 | Fujishiro et al. | |
| 2004/0170446 | A1 | 9/2004 | Nagashima et al. | |
| 2004/0170447 | A1 | 9/2004 | Arai et al. | |
| 2004/0223782 | A1 | 11/2004 | Hosokawa et al. | |
| 2005/0238384 | A1 | 10/2005 | Sampe et al. | |
| 2005/0271424 | A1 | 12/2005 | Zemba | |

FOREIGN PATENT DOCUMENTS

| | | | |
|---|---|---|---|
| CN | 1420393 | A | 5/2003 |
| JP | 2003-255692 | | 9/2003 |
| JP | 2003-270923 | | 9/2003 |
| JP | 2003-270954 | | 9/2003 |
| JP | 2004-109873 | | 4/2004 |
| JP | 2004-170440 | | 6/2004 |
| JP | 2004-191835 | | 7/2004 |
| JP | 2004-191881 | | 7/2004 |
| JP | 2005037876 | A * | 2/2005 |

* cited by examiner

*Primary Examiner*—Susan S Lee
(74) *Attorney, Agent, or Firm*—Oblon, Spivak, McClelland, Maier & Neustadt, P.C.

(57) ABSTRACT

An image forming apparatus includes a container configured to contain two-component developer including toner particles and carrier beads. The image forming apparatus further includes a developer carrying member configured to carry thereon the two-component developer and having a magnetic field generating member and a plurality of grooves having a generally V-like shape satisfying $h \geqq 50+R/2+\{(R/2)/\sin(\theta/2)\}$, in which h represents a depth of the grooves, θ represents an opening angle of the grooves, and R represents a volume-average diameter of the carrier beads.

16 Claims, 8 Drawing Sheets

APPARATUS FOR FOMING IMAGES

BACKGROUND

1. Technical Field

This specification generally describes an apparatus for image forming, and more particularly describes an apparatus capable of stably developing images.

2. Discussion of the Background

In a general image forming apparatus using two-component developer, the image forming apparatus may have a rotary non-magnetic sleeve including a plurality of magnets. The two-component developer refers to developer including toner particles and carrier beads and is hereafter simply referred to as developer.

The sleeve, serving as a developer carrying member, may have its surface grooved or roughened (e.g. sandblasted) to prevent a slippage of the developer, thereby increasing a developer carrying capacity.

The grooved sleeves are found to be less susceptible to wearing over time than the sandblasted sleeves. However, the grooved sleeves may produce an image with periodically varying densities corresponding to a pitch of the grooves, which is hereafter referred to as a banding effect.

Deeper grooves may achieve a higher developer carrying capacity but may cause a banding effect because of different development fields between groove areas and non-groove areas. Shallower grooves may cause a banding effect because of reduced developer carrying capacity.

There is a background image forming apparatus having a sleeve having grooves whose depth is defined to be from 0.05 mm to 0.15 mm.

When finer toner particles are used, the banding effect may become more noticeable because of an improved image reproduction capability.

There is another background image forming apparatus using two-component developer including toner particles whose diameter is from 4 μm to 8.5 μm. The image forming apparatus has a sleeve having a plurality of longitudinally extending grooves. The grooves are disposed with a pitch smaller than a movement of a PC drum within a development zone. In this manner, the development zone of the PC drum may be always in contact with at least one groove on the sleeve, thus reducing a banding effect.

SUMMARY

An image forming apparatus including a container configured to contain two-component developer including toner particles and carrier beads, and a developer carrying member configured to carry thereon the two-component developer and having therein a magnetic field generating member and having thereon a plurality of grooves having a generally V-like shape satisfying $$h \geqq 50 + R/2 + \{(R/2)/\sin(\theta/2)\},$$

wherein h represents a depth of the grooves, θ represents an opening angle of the grooves, and R represents a volume-average diameter of the carrier beads.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
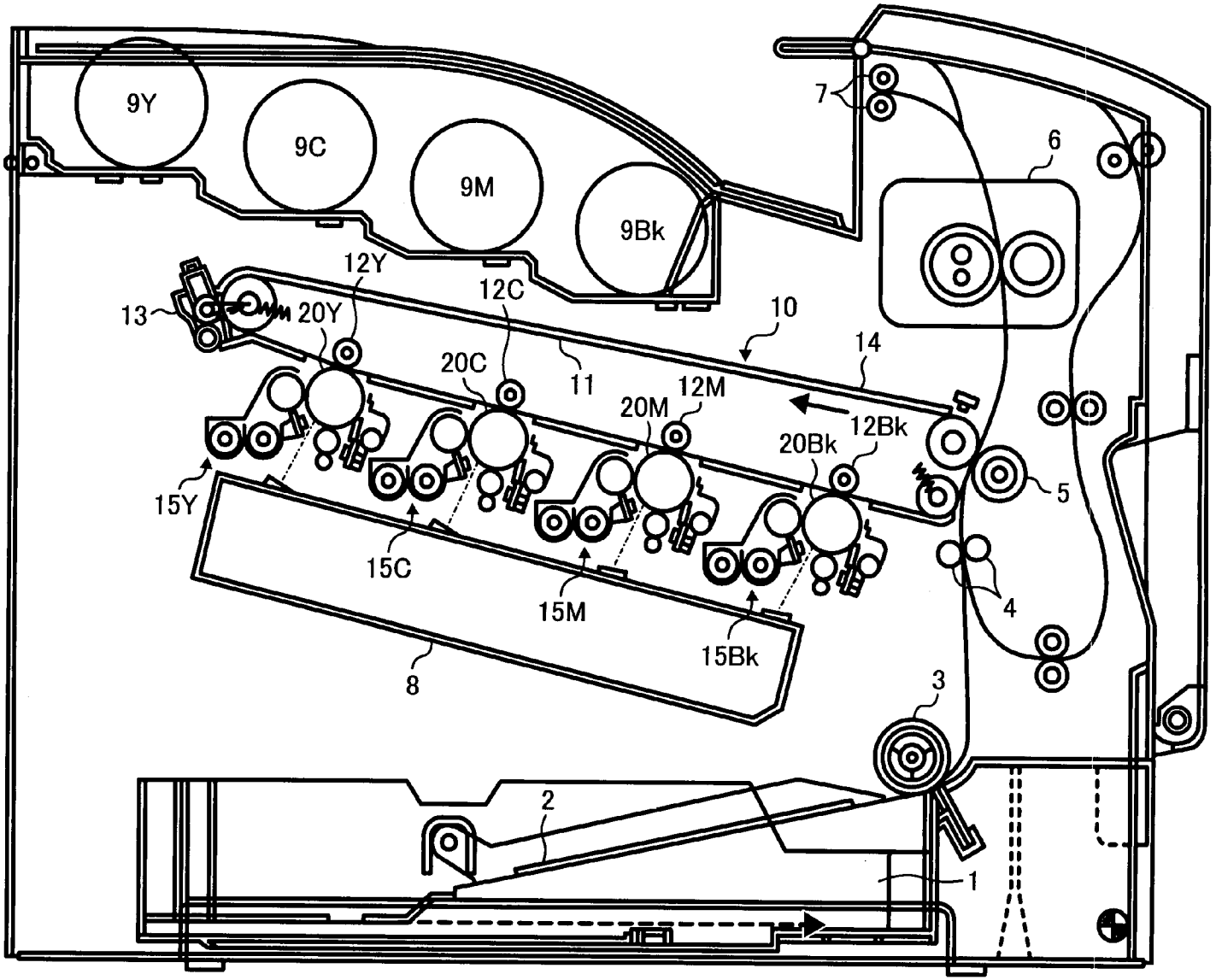
FIG. 1 is a schematic diagram illustrating a color image forming apparatus according to an example embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, a color image forming apparatus according to a preferred example embodiment of the present invention is described.

Members marked with Y, C, M, and Bk hereafter refer to members serving to form images of yellow, cyan, magenta, and black, respectively. The image forming apparatus uses two-component developer including toner particles and carrier beads, hereafter simply may be referred to as developer.

The image forming apparatus includes imaging stations 15Y, 15C, 15M, and 15Bk (collectively referred to as imaging stations 15), an optical unit 8, an intermediate transfer unit 10, a sheet cassette 1, a pickup roller 3, a registration roller pair 4, a fixer unit 6, and toner bottles 9Y, 9C, 9M, and 9Bk.

The imaging stations 15 are located at a central part of the image forming apparatus. Each of the imaging stations 15 includes a drum-like photoconductive member 20 (hereafter referred to as PC drums 20), serving as an image carrying member. The imaging stations 15 serve to form toner images of respective colors on the PC drums 20.

The optical unit 8, disposed below the imaging stations 15, serves to expose the PC drums 20 with beams of laser light.

The intermediate transfer unit 10, disposed above the imaging stations 15, includes an intermediate transfer belt 11 (hereinafter simply referred to as a belt 11), primary transfer rollers 12Y, 12C, 12M, and 12Bk, a secondary transfer roller 5, and a belt cleaning unit 13. The belt 11 and the primary transfer rollers 12Y, 12C, 12M, and 12Bk are supported by a belt case 14 as a unit.

The belt 11 is stretched across a plurality of rollers. The primary transfer rollers 12Y, 12C, 12M, and 12Bk serve to transfer a toner image formed on the PC drums 20Y, 20C, 20M, and 20Bk, respectively, to the belt 11.

The secondary transfer roller 5 further transfers the toner image formed on the belt 11 to a sheet 2 serving as a recording medium. The belt cleaning unit 13, disposed in contact with the belt 11, removes toner particles remaining on the belt 11 after the toner image is transferred to the sheet 2.

The fixer unit 6 applies heat and pressure to the toner image transferred onto the sheet 2 so as to fix the toner image to the sheet 2. The fixer unit 6 has an output roller pair 7 that outputs the sheet 2, onto which the toner image is fixed, out of the image forming apparatus.

The sheet cassette stores the sheet 2. The pickup roller 3 is disposed in proximity to the sheet cassette 2 and conveys the sheet 2 to a secondary transfer section, which refers to a position between the belt 11 and the secondary transfer roller 5. On a sheet path between the pickup roller 3 and the secondary transfer roller 5, there is disposed a registration roller pair 4 that adjusts a timing to feed the sheet 2 to the secondary transfer section.

At a top portion of the image forming apparatus, toner bottles 9Y, 9C, 9M, and 9Bk, each containing toner particles of respective colors, are mounted.

Figure 2:
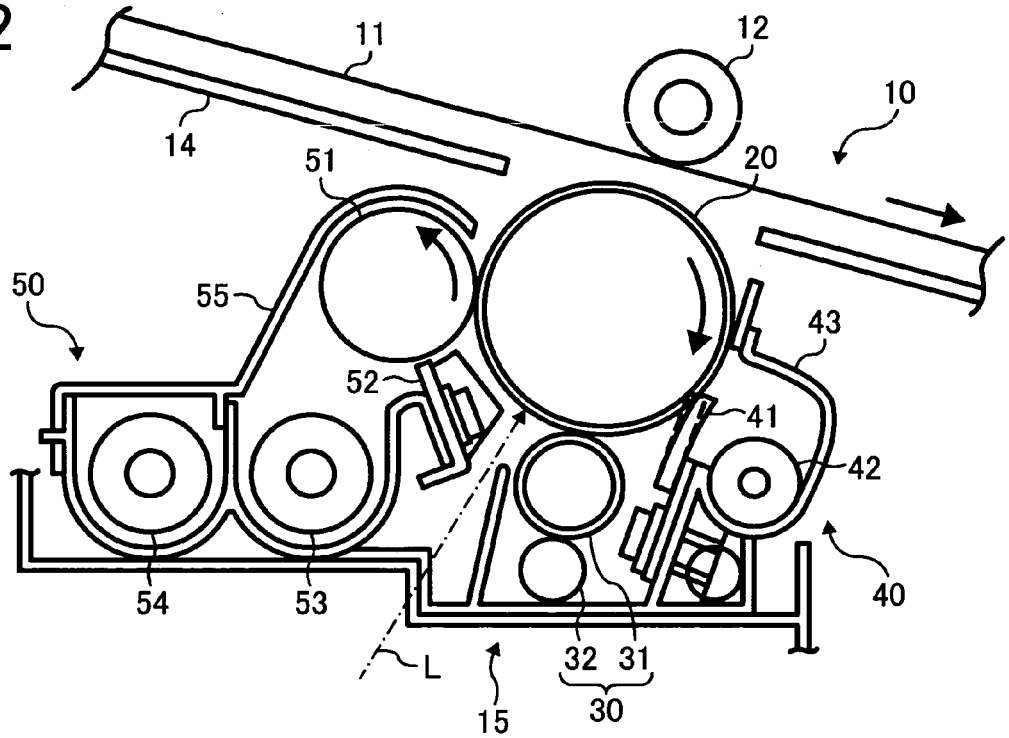
FIG. 2 is a schematic diagram illustrating an imaging station of the image forming apparatus of FIG. 1.

Referring to FIG. 2, the imaging station 15 is described in detail. Each of the imaging stations 15 has a common structure except for a difference in color.

The imaging station 15 further includes a charger 30, a cleaning unit 40, and a development unit 50.

The charger 30 has a charge roller 31 for charging the PC drum 20 and a cleaning roller 32 for cleaning a surface of the charge roller 31.

The development unit 50 has a developer case 55 serving as a developer container. In the developer case 55, there are provided a first screw 53 and a second screw 54 serving as agitating members, a sleeve 51 serving as a developer carrying member, and a doctor blade 52 serving as a regulating member.

The developer case 55 has an opening through which the sleeve 51 faces the PC drum 20 forming a predetermined gap therebetween. An area between the sleeve 51 and the PC drum 20 may be hereafter referred to as a development zone D.

The cleaning unit 40 includes a case 43, a cleaning blade 41, and a waste-toner screw 42. The case 43 has an opening. The toner particles remaining on the PC drum 20 are cleaned off by the cleaning blade 41 and are then conveyed by the waste-toner screw 42 to a waste-toner bottle (not shown).

A manner in which the above-described image forming apparatus obtains a color image is now described.

In each of the imaging stations 15, the charger 30 may uniformly charge a surface of the PC drum 20. The optical unit 8 scans the surface of the PC drum 20 with a beam L of laser light based on image information so as to form a latent image on the surface of the PC drum 20.

The latent image formed on the PC drum 20 may be developed with toner particles of each color, which is supplied by the sleeve 51, so as to form a visible image referred to as a toner image.

By the action of the primary transfer roller 12, the toner image on the PC drum 20 is sequentially and superposedly transferred onto the belt 11 rotationally driven counterclockwise, which operation is referred to as a primary image transfer. Timings at which the toner images of each color are transferred are suitably adjusted such that the toner images of each color are superposedly transferred onto a substantially equal position of the belt 11.

After a primary transfer, the surface of the PC drum 20 is cleaned by the cleaning unit 40 so as to be ready for a next image formation.

Meanwhile, also referring to FIG. 1, the sheet 2 in the sheet cassette 1 is conveyed by the pickup roller near the sheet cassette 1 to the registration roller pair 4. The registration roller pair 4 feeds the sheet 2 to the secondary transfer section at a predetermined timing.

At the secondary transfer section, the toner images formed on the belt 11 is transferred onto the sheet 2. The sheet 2 on which the toner image is transferred then passes thorough the fixer unit 6. The fixer unit 6 fixes the toner image to the sheet 2. The output roller pair 7 output the sheet 2 out of the image forming apparatus.

Similarly to the PC drum 20, the residual toner particles on the belt 11 are cleaned by the belt cleaning unit 13. Toner filled in the toner bottle 9 is replenished to each of the development units 50 by a predetermined amount as needed, through a path that is not shown.

Figure 3:
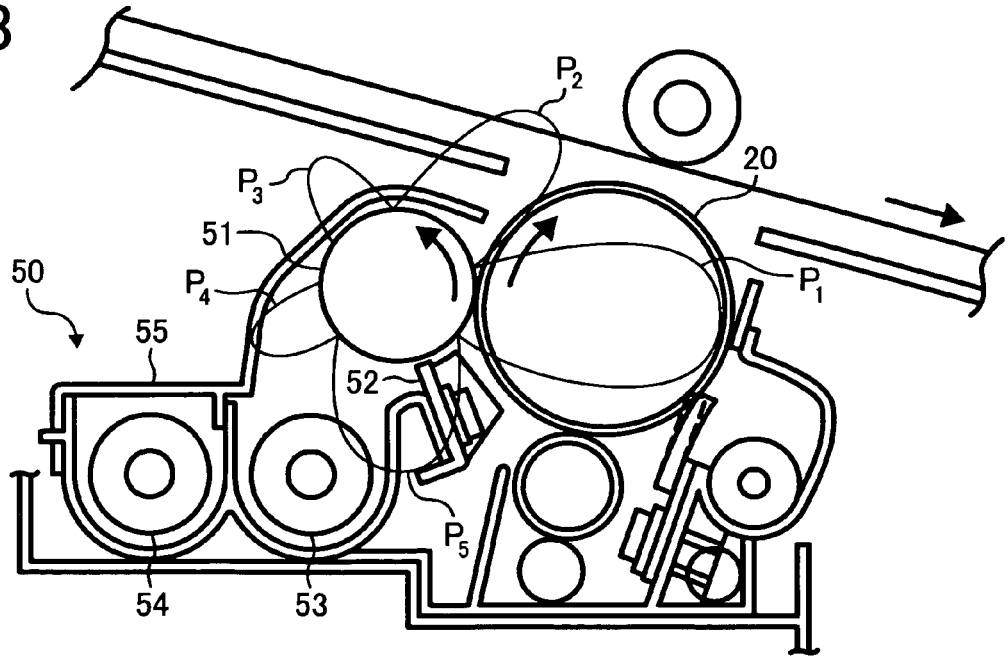
FIG. 3 is an illustration for explaining an operation of a developing unit of the imaging station of FIG. 2.

Referring now to FIG. 3, the development unit 50 of the imaging station 15 is described in more detail.

The sleeve 51 is formed of a non-magnetic material such as aluminum, brass, stainless steel, and conductive resin, has a tube-like form and rotates counterclockwise, driven by a rotary drive mechanism (not shown).

The sleeve 51 includes a magnet roller formed of a plurality of fixed magnets, which generate magnetic fields. The sleeve 51 may carry the developer by attracting the developer using the magnetic force.

$P_1$ is a main pole disposed to face the PC drum 20 so that a peak magnetic force of $P_1$ is directed to a center of the PC drum 20. Poles $P_1$, $P_2$, $P_3$, $P_4$, and $P_5$ are disposed in this order in a rotation direction of the sleeve 51.

$P_2$ serves to attract developer having been used in the development zone D toward the developer case 55 in syncronism with a rotation of the sleeve 51.

$P_4$ attracts developer to the sleeve 51 from the first screw 53.

$P_3$ is formed to have a common polarity with $P_4$ and is disposed between $P_2$ and $P_4$. $P_3$ generates a repulsive magnetic field against a magnetic force of $P_4$ so that the developer attracted by $P_2$ falls off the sleeve 51.

$P_5$ carries the developer on the surface of the sleeve 51, which has been picked up by $P_4$, to a position of the doctor blade 52. The doctor blade 52 regulates a thickness (i.e. an amount) of the developer. While conveying the developer, $P_5$ also serves to pick up the developer conveyed by the first screw 53.

Next, movement of the developer in the development unit 50 is described.

In the developer case 55, the first screw 53 and the second screw 54 convey and agitate the developer, which includes toner particles and carrier beads. While being conveyed and agitated, the toner particles and the carrier beads are triboelectrically charged.

The carrier beads are attracted to the sleeve 51 so that the carrier beads stand up on the sleeve 51 in a brush-like form along lines of the magnetic force generated by the magnet roller in the sleeve 51. Since charged toner particles adhere to the standing carrier beads, magnetic brushes are formed on the sleeve 51.

As the sleeve 51 rotates, the magnetic brushes are transported in a direction the sleeve 51 rotates. The doctor blade 52, disposed upstream of the development zone D, regulates a height of the magnetic brushes (i.e. an amount of the developer carried by the sleeve 51).

Reaching the development zone D facing the PC drum 20, the magnetic brushes on the sleeve 51 come in contact with the PC drum 20 having the latent image thereon. The magnetic brushes supply the latent image with toner particles so that the latent image is developed into a toner image.

After supplying toner particles, the developer remaining on the sleeve 51 is stripped off the surface of the sleeve 51 by a repulsive force generated by the poles $P_2$ and $P_3$. Then the developer returns to the developer case 55 to be conveyed and agitated by the first screw 53 and the second screw 54 again.

When a density of the toner particles in the developer inside the developer case 55 falls below a predetermined level, toner particles are supplied via a toner-supply port (not shown). The agitation performed by the first screw 53 and the second screw 54 mixes the newly supplied toner particles with the existing developer. The developer adjusted to a predetermined toner density is then picked up by the sleeve 51 to repeat the above-described operation.

Image forming conditions used in the image forming apparatus according to the example embodiment is as follows: a linear velocity of the PC drum 20 is 155 mm/sec, a potential of a non-exposed portion of the PC drum 20 is −500V, a potential of an exposed portion of the PC drum 20 is −50V, and a development bias is −350V.

Figure 4:
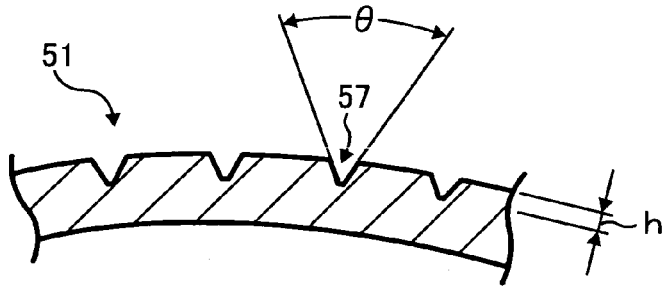
FIG. 4 is a cross-sectional exploded view of a surface of a sleeve of the developing unit of FIG. 3.

Referring to FIG. 4, the surface of the sleeve 51 has a plurality of grooves 9. The grooves 9 are disposed evenly spaced and are extending in a longitudinal direction.

Generally, the deeper the grooves 57 are, the more the developer carrying capacity may be and the more likely the banding effect may occur due to different strength of development fields. The shallower the grooves 57 are, the less the developer carrying capacity may be especially when the grooves 57 get clogged with the toner particles, the carrier beads, etc.

The following experiments have been conducted with reference to an angle θ and a groove depth h (μm) of the grooves 57 corresponding to a size of the carrier beads.

A running test was conducted in which a chart having an image area ratio of 5% was printed for 300 jobs while 100 sheets are printed per job. That is, a sum total of 30,000 sheets were printed. During the running test, the toner density was kept to 9% by weight.

After the running test, a solid image was printed on 10 sheets in a row. Among the 10 sheets, a sheet having the highest level of banding effect was evaluated.

Evaluations were performed on a number of combinations: the carrier beads having a volume-average diameter R of 30, 35, 45, 59, and 72 μm, and depth h μm of varying levels.

Figure 5:
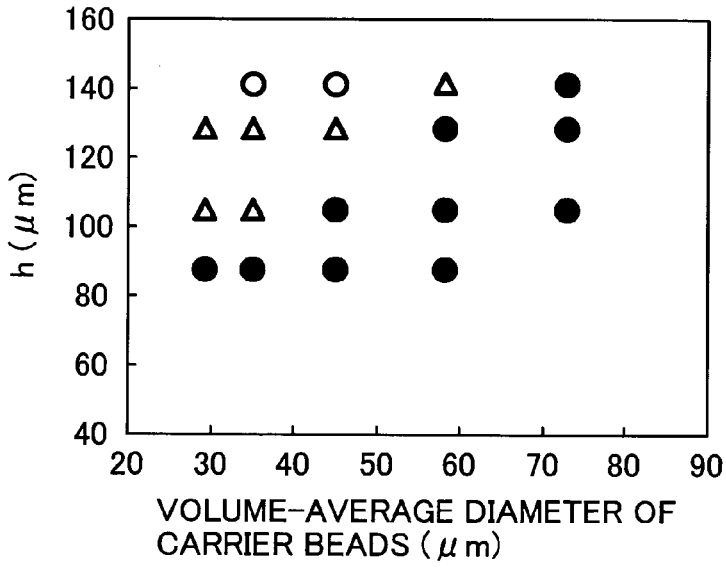
FIGS. 5 through 7 are graphs showing relationships between a volume-average diameter of carrier beads and a depth of grooves on the sleeve.
Figure 6:
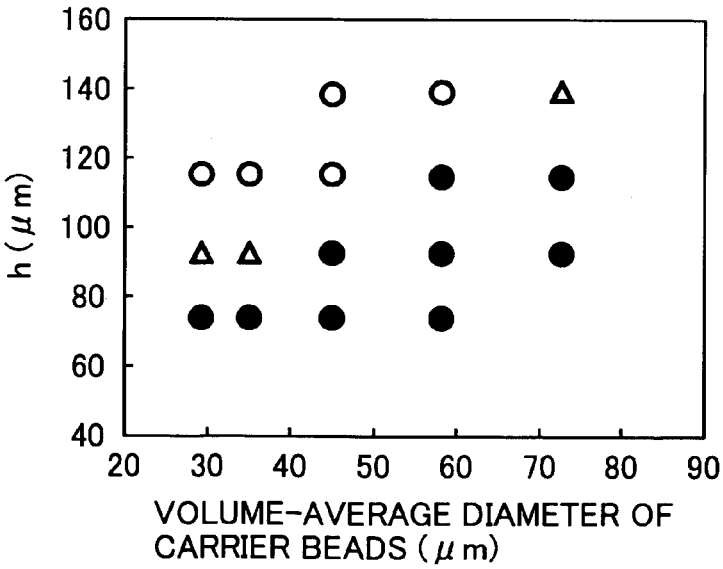
Figure 7:
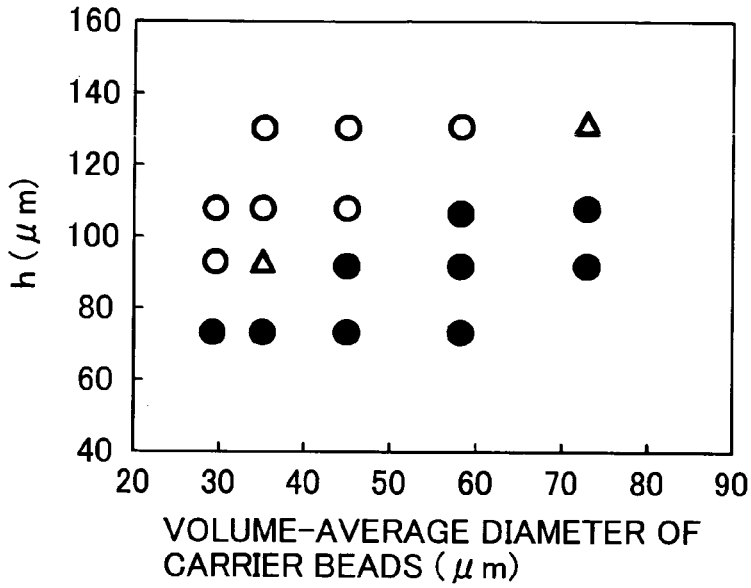

FIG. 5 shows an evaluation result when the angle θ of the grooves 57 was set to 60°. FIG. 6 shows an evaluation result when the angle θ was set to 90°. FIG. 7 shows an evaluation result when the angle θ was set to 120°.

In the graphs shown in FIGS. 5 to 7, A indicates that no banding effect has occurred. B indicates that a slight banding effect has occurred but at a level practically acceptable. F indicates that an unacceptable level of banding effect has occurred. An image evaluated as A or B is hereafter referred to as a banding-less image.

In the above experiment, the sleeve 51 had a diameter of 18 mm, and the sleeve 51 had 100 grooves 57.

The experiment has confirmed that a banding-less image may be created by a certain combination of the depth, the angle, and the volume-average diameter of the carrier beads.

Figure 10:
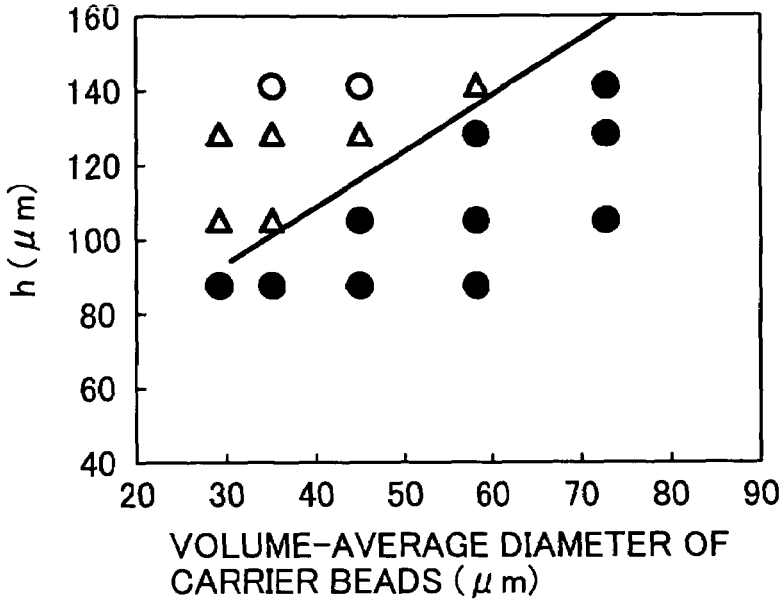
FIGS. 10 to 12 are graphs corresponding to FIGS. 5 to 7, respectively, each having a border line being added.
Figure 11:
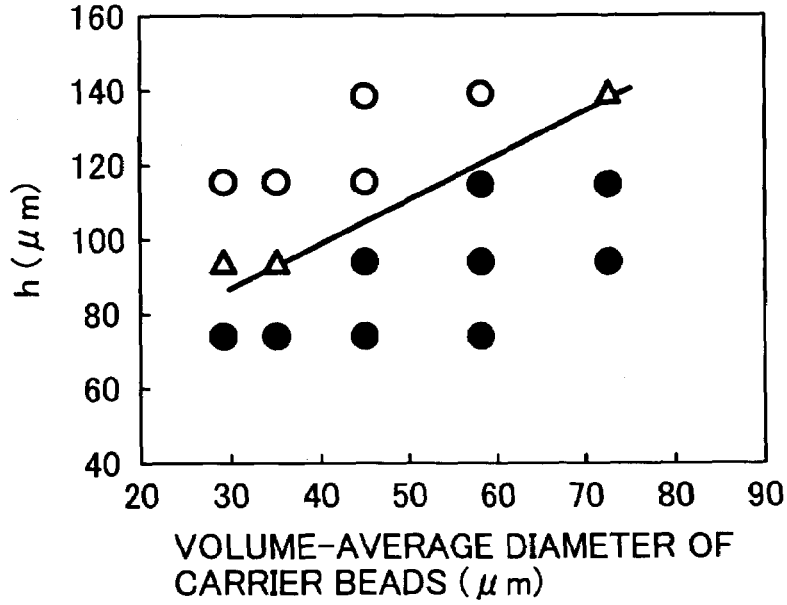
Figure 12:
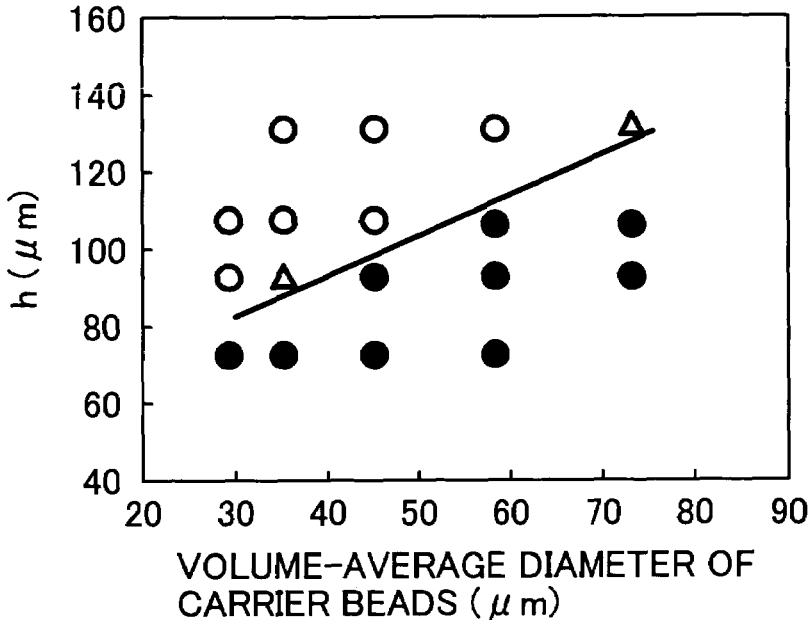

In each of FIGS. 5, 6, and 7, a line may be drawn between an A B area and an F area as shown in FIGS. 10, 11, and 12, respectively. FIGS. 10 through 12 confirm that a banding-less image may be achieved when the depth of the grooves satisfies the following relation (1):

$$H \geqq 50 + R/2 + \{(R/2)/\sin(\theta/2)\} \quad (1),$$

wherein h is depth (μm) of the groove 57, R (μm) is a volume-average diameter of the carrier beads, and θ is an angle of a V shape of the groove 57.

Figure 8:
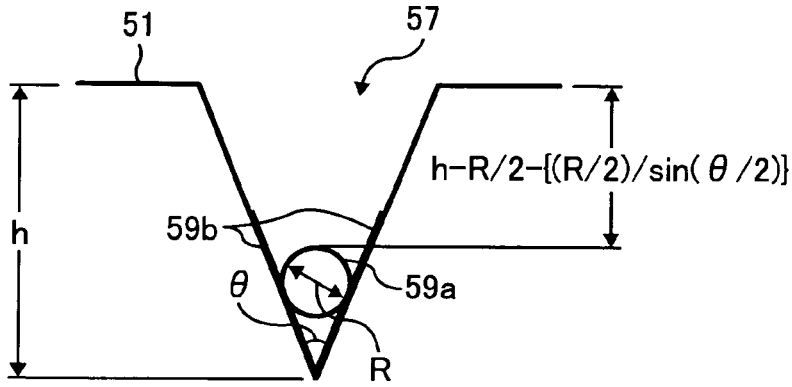
FIG. 8 is an illustration of a state in which a groove on the sleeve is clogged with an approximately one carrier bead through toner particles.

FIG. 8 is an illustration for explaining the formula (1) in which the groove 57 is clogged with approximately one carrier bead 59*a* through toner particles 59*b*.

After the groove 57 is clogged with a carrier bead 59 through the running test, a substantial depth of the groove 57 may become smaller than the initial depth h. The substantial depth may be represented by the following formula (2).

$$H - R/2 - \{(R/2)/\sin(\theta/2)\} \quad (2)$$

That is, the formula (1) represents that a banding-less image may be achieved while the substantial depth is 50 μm or more.

When the substantial depth is less than 50 μm, the developer may slip on the sleeve 51, or the amount of the developer carried by the groove 57 may decline. As a result, a developer carrying capacity of the sleeve 51 may decline.

After the above experiment, an additional running test has been conducted until a total of 60,000 sheets were printed. However, evaluation results did not indicate substantial changes.

Figure 9:
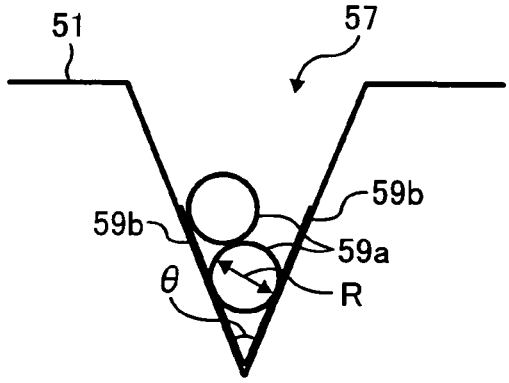
FIG. 9 is an illustration of a state in which a groove on the sleeve is clogged with two carrier beads through toner particles.

In the example embodiment, the groove 57 is more likely to be clogged with a single carrier bead 59*a* as shown in FIG. 8 than with a plurality of carrier beads 59*a* as shown in FIG. 9.

In FIG. 8, the carrier bead 59*a* is supported on both sides by adhering to the toner particles 59*b* that adhere on two walls of the groove 57. In FIG. 9, on the other hand, an upper carrier bead is supported on only one wall of the groove 57, thus being less readily retained in the groove 57.

Therefore, the grooves 57 are likely to be clogged with approximately one carrier bead 59*a*.

Further, the phenomenon in which the grooves 57 are clogged with approximately one carrier bead 59*a* may be similar in other types of the sleeve 51. Sleeves having 50 to 120 grooves have exhibited the phenomenon.

Figure 13:
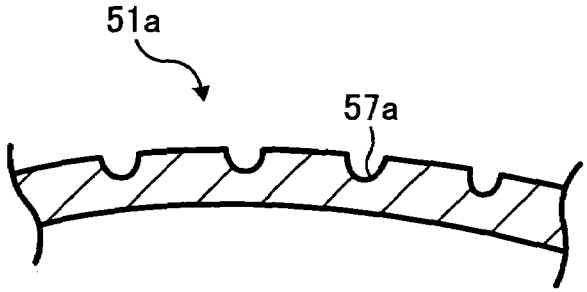
FIG. 13 is an illustration of grooves on the sleeve according to another example embodiment.
Figure 14:
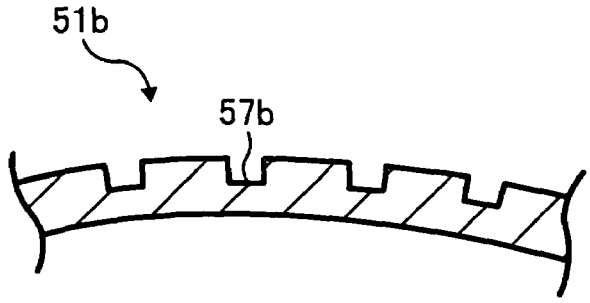
FIG. 14 is an illustration of grooves on the sleeve according to another example embodiment.

In addition to V-shaped grooves as in the example embodiment, a similar model may be applied to U-shaped grooves 57*a* as shown on a sleeve 51*a* of FIG. 13 or trapezoidal grooves 57*b* as shown on a sleeve 51*b* of FIG. 14.

Further, experiments have confirmed that an optimal depth for achieving a banding-less image also depends on the angle θ.

When the angle θ is less than 60°, the developer carrying capacity of the sleeve 51 has declined. The developer may have slipped on the sleeve 51.

When the angle θ is more than 120°, a noticeable level of banding effect has occurred. In the development zone D, an area where a groove 57 faces the PC drum 20 produces a weaker development field than an area without a groove 57, causing the developing capacity to decline. Therefore, a substantially wide angle θ (i.e. a wide groove 57) causes a wide light-colored portion on a produced image, which leads to a noticeable banding effect.

Therefore, the sleeve 51 of the image forming apparatus according to the example embodiment has a V-shaped groove having an angle from 60° to 120°, and satisfies the formula (1). Thus, a banding-less image may be formed even when the groove 57 is clogged with the carrier bead 59*a* and the toner particles 59*b*.

Figure 15:
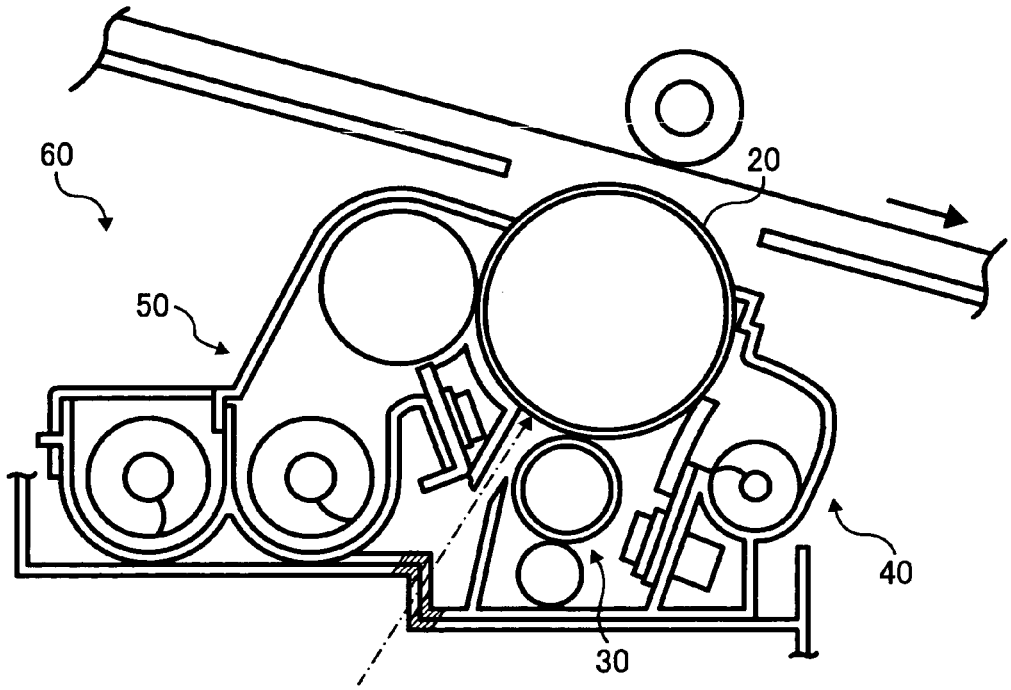
FIG. 15 is an example diagram of a process cartridge including the development unit, a PC drum a charger, and a cleaning unit of the image forming apparatus of FIG. 1 as a unit.
Figure 16:
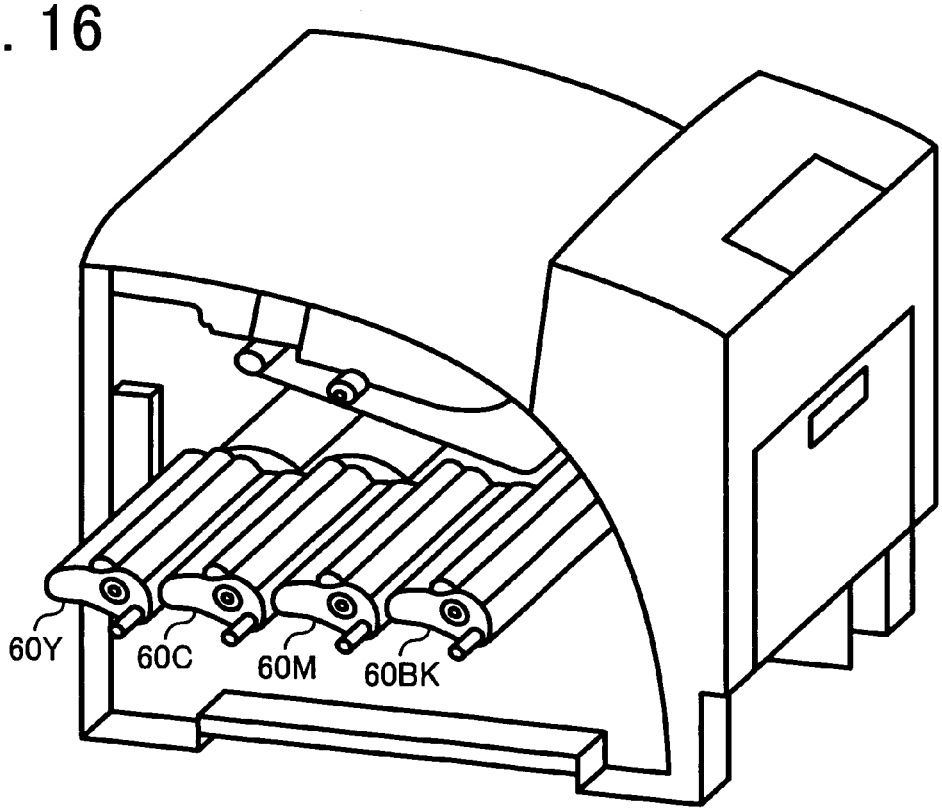
FIG. 16 is a perspective illustration of the process cartridge of FIG. 15 being removed from the image forming apparatus of FIG. 1.

As illustrated in FIG. 15, an image forming apparatus according to an example embodiment may include the development unit 50, the PC drum 20, the charger 30, and the cleaning unit 40 as a unit removable from the image forming apparatus. The unit is hereafter referred to as a process cartridge 60, which collectively refers to process cartridges 60Y, 60C, 60M, and 60Bk for each color. Using the process cartridge 60, a user may replace the PC drum 20, the development unit 50, the charger 30, and the cleaning unit 40 at one time. As illustrated in FIG. 16, the process cartridges 60Y, 60C, 60M, and 60Bk may be removed from the image forming apparatus.

Next, toner particles are described in detail.

In general, fine-grain toner particles may improve image quality but are apt to coagulate. To prevent the coagulation and to enhance tribo-electrification characteristics of the toner particles, an amount of an additive such as silica may be increased. The toner particles with increased additive may have more mobility and are less likely to coagulate. However, an absolute amount of the additive liberated from the toner particles also increases, and coagulation of the liberated additive sometimes occurs. Thus-formed coagulated masses of additive may also adhere to the grooves 57 leading to an occurrence of a banding effect over time.

For an environmental point of view, toner particles including wax may be used for oil-less fixing. The toner particles including wax are also likely to adhere to the grooves 57.

Toner particles preferably used in the image forming apparatus according to the example embodiment have a weight-average diameter of 3 to 10 μm. Such toner particles have a diameter small enough to develop minute dots of the latent image and have an excellent dot reproduction capability.

Toner particles having a weight-average diameter of less than 3 μm are apt to experience a decrease in transfer efficiency, cleanability of the cleaning blade 41, and the like. Toner particles having a weight-average diameter of more than 10 μm are apt to cause spattering on developed characters or lines.

Polymerized toner particles, which are manufactured using a polymerization method, are increasingly used for stable mass production of fine-grain toner particles. Polymerized toner particles may be precisely manufactured at a level of 3 μm smaller than pulverized toner particles. Polymerized toner particles may also have their shape controlled.

Next, measurement of particle-size distribution of toner particles is described. The particle-size distribution may be measured by a measurement instrument using the Coulter principle such as the Coulter counter TA-II, the Coulter Multisizer II, both of which are manufactured by Beckman Coulter, Inc.

Specifically, 0.1 to 5 ml of a surface-active agent serving as dispersant, preferably alkylbenzene sulfonates, is poured into 100 to 150 ml of an electrolytic solution. The electrolytic solution refers to an approximately 1% NaCl aqueous solution prepared by using primary sodium chloride. For example, ISOTON-II manufactured by Beckman Coulter, Inc. may be used as the electrolytic solution.

Then a 2 to 20 mg of measurement sample is added into the electrolytic solution. The electrolytic solution suspending the measurement sample is subjected to dispersion treatment by using an ultrasonic disperser for approximately one to three minutes.

Using the above described measurement instrument with an aperture of 100 μm, a volume and a number of the toner particles are measured. Then volume distribution and a number distribution of toner particles may be obtained through calculation. From the obtained distribution, a weight-average diameter (D4) and a number-average diameter (D1) of the toner particles may be further obtained.

The following 13 channels are used: less than between 2.00 and 2.52 μm; less than between 2.52 and 3.17 μm; less than between 3.17 and 4.00 μm; less than between 4.00 and 5.04 μm; less than between 5.04 and 6.35 μm; less than between 6.35 and 8.00 μm; less than between 8.00 to 10.08 μm; less than between 10.08 and 12.70 μm; less than between 12.70 and 16.00 μm; less than between 16.00 and 20.20 μm; less than between 20.20 and 25.40 μm; and less than between 25.40 and 32.00 μm; less than between 32.00 and 40.30 μm, and particles having a diameter of 2.00 μm or more and less than 40.30 μm are the target of the measurement.

The toner particles used in the image forming apparatus of the example embodiment preferably have a spindle shape.

Irregular-shaped or flat-shaped toner particles generally have a low particle mobility, and therefore are apt to be charged insufficiently. Generally, insufficiently charged toner particles may produce a defective image such as a background smear.

The irregular-shaped or flat-shaped toner particles are not likely to be disposed precisely or uniformly, and therefore may not have a good dot reproduction capability when developing minute dots of the latent image. Further, the irregular-shaped or flat-shaped toner particles are not much influenced by electric lines of force, and therefore are not efficiently transferred when an electrostatic transfer method is used.

Substantially spherical toner particles generally have so high a particle mobility that the toner particles overreact against an external force, and are likely to spatter around a dot when being developed or transferred. Further, spherical toner particles easily roll on the PC drum 20 and slip into a gap between the PC drum 20 and members forming the cleaning unit 40, thus causing a cleaning deficiency.

On the other hand, the spindle-shaped toner particles may have an appropriately-adjusted particle mobility, and therefore may become sufficiently charged, so as not to cause a background smear and the like.

The spindle-shaped toner particles may be neatly aligned on minute dots of the latent image. Therefore, the toner particles may be effectively transferred, thus having an excellent dot reproduction capability. During transfer, an appropriate level of particle mobility prevents the toner particles from spattering.

Further, the spindle-shaped toner particles have fewer rotating axes, and therefore not likely to slip into a gap below the members of the cleaning unit 40.

Figure 17A:
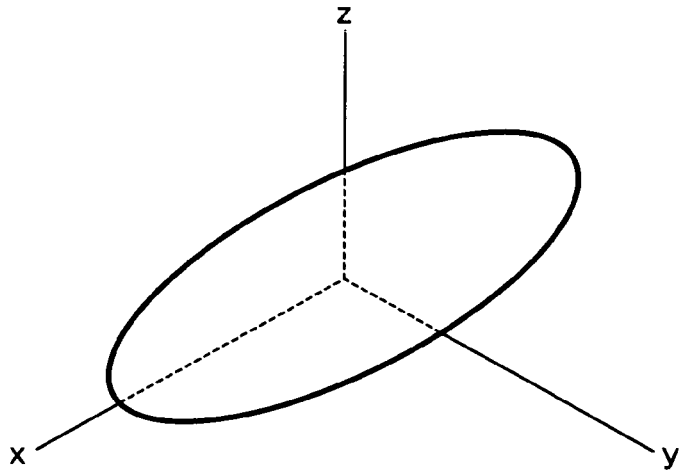
FIG. 17A illustrates an example shape of a toner particle on xyz coordinates.
Figure 17B:
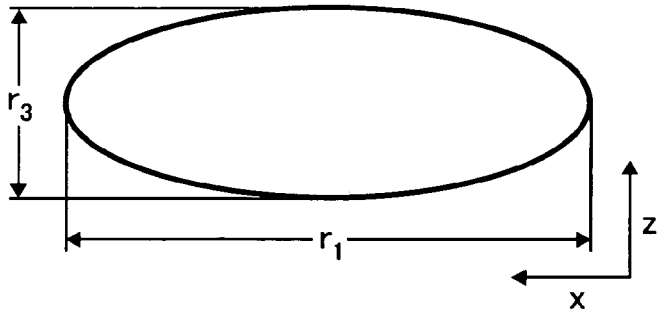
FIG. 17B is similar to FIG. 17A based on xz coordinates.
Figure 17C:
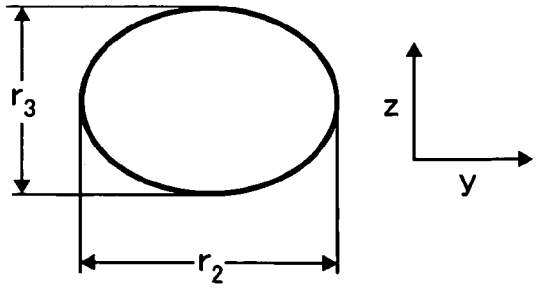
FIG. 17C is similar to FIG. 17A based on yz coordinates.

As illustrated in the spindle-shape toner particle of FIGS. 17A to 17C, the ratio of a major axis r1 and a minor axis r2 (i.e. r2/r1) is preferably from 0.5 to 0.8. The ratio of a thickness r3 and the minor axis r2 (i.e. r3/r2) is preferably from 0.7 to 1.0.

Toner particles having the above configuration have a shape that is not irregular, flat or spherical. Therefore, the toner particles may exhibit satisfactory tribo-electrification characteristics, dot reproduction capability, transfer effectiveness, prevention of spattering, cleanability, and the like.

Toner particles having the ratio r2/r1 of less than 0.5 may be far from spherical, and therefore have a high cleanability; however, the toner particles may also have less dot reproduction capability and transfer effectiveness.

A shape of toner particles having the ratio r2/r1 of more than 0.8 may resemble a sphere, and therefore may be likely to cause a cleaning deficiency.

A shape of toner particles having the ratio r3/r2 less than 0.7 may be flat. The flat toner particles may be less likely to spatter compared to irregular-shaped toner particles. However, the toner particles have less transfer efficiency.

Particularly, when r3/r2 is more than 1.0, the toner particles come to rotate on their major axis, and are more likely to cause a cleaning deficiency.

The above-described example embodiment is illustrative, and numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. 2005-067027 filed on Mar. 10, 2005 in the Japan Patent Office, the entire contents of which are incorporated by reference herein.

What is claimed is:

1. An image forming apparatus, comprising:

a container configured to contain two-component developer including toner particles and carrier beads;

an agitating member configured to agitate and convey the two-component developer in the container;

a developer carrying member configured to pick up the two-component developer from the container to carry thereon the two-component developer, the developer carrying member having therein a magnetic field generating member including a plurality of fixed magnets and having formed thereon a plurality of grooves with a generally V-like shape and whose depth satisfies $$h \geqq 50 + R/2 + \{(R/2)/\sin(\theta/2)\},$$

in which h represents the depth of the grooves, θ represents an opening angle of the grooves, and R represents a volume-average diameter of the carrier beads; and a regulating member extending toward the developer carrying member from below the developer carrying member, disposed at a predetermined distance from the developer carring member and configured to regulate an amount of the two-component developer carried on the developer carrying member.

2. The image forming apparatus of claim 1, wherein R is from 30 to 72 μm.

3. The image forming apparatus of claim 1, wherein θ is from 60° to 120°.

4. The image forming apparatus of claim 1, wherein the toner particles of the two-component developer are provided in the container and have a weight-average diameter of 3 to 10 μm.

5. The image forming apparatus of claim 1, wherein the toner particles are provided in the container and have a spindle shape.

6. The image forming apparatus of claim 1, wherein the toner particles are provided in the container and have a major axis r1, a minor axis r2, and a thickness r3 satisfying r2/r1 of 0.5 to 0.8 and r3/r2 of 0.7 to 1.0.

7. A development unit comprising:

a container configured to contain two-component developer including toner particles and carrier beads;

an agitating member configured to agitate and convey the two-component developer in the container;

a developer carrying member configured to pick up the two-component developer from the container to carry thereon the two-component developer, the developer carrying member having therein a magnetic field generating member including a plurality of fixed magnets and having formed thereon a plurality of grooves with a generally V-like shape and whose depth satisfies $$h \geqq 50 + R/2 + \{(R/2)/\sin(\theta/2)\},$$

in which h represents the depth of the grooves, θ represents an opening angle of the grooves, and R represents a volume-average diameter of the carrier beads; and a regulating member extending toward the developer carrying member from below the developer carrying member, disposed at a predetermined distance from the developer carring member and configured to regulate an amount of the two-component developer carried on the developer carrying member.

8. A process cartridge removably attached to an apparatus, integrally comprising at least one of:

the development unit of claim 7;

a photoconductive member on which a latent image is formed; and a cleaning member configured to clean a surface of the photoconductive member.

9. A process cartridge removably attached to an apparatus, integrally comprising the development unit of claim 7, the process cartridge further integrally comprising at least one of:

a photoconductive member on which a latent image is formed; and cleaning means for cleaning a surface of the photoconductive member.

10. An image forming apparatus, comprising:

a container configured to contain two-component developer including toner particles and carrier beads;

agitating means for agitating and conveying the two-component developer in the container;

developer carrying means for picking up the two-component developer from the container and carrying the two-component developer thereon, the developer carrying means having therein a magnetic field generating means including a plurality of fixed magnets and having formed thereon a plurality of grooves with a generally V-like shape and whose depth satisfies $$h \geqq 50 + R/2 + \{(R/2)/\sin(\theta/2)\},$$

in which h represents the depth of the grooves, 74 represents an opening angle of the grooves, and R represents a volume-average diameter of the carrier beads; and regulating means extending toward the developer carrying means from below the developer carring means, disposed at a predetermined distance from the developer carring means for regulating an amount of the two-component developer carried on the developer carrying means.

11. The image forming apparatus of claim 10, wherein R is from 30 to 72 μm.

12. The image forming apparatus of claim 10, wherein θ is from 60° to 120°.

13. The image forming apparatus of claim 10, wherein the toner particles of the two-component developer are provided in the container and have a weight-average diameter of 3 to 10 μm.

14. The image forming apparatus of claim 10, wherein the toner particles are provided in the container and have a spindle shape.

15. The image forming apparatus of claim 10, wherein the toner particles are provided in the container and have a major axis r1, a minor axis r2, and a thickness r3 satisfying r2/r1 of 0.5 to 0.8 and r3/r2 of 0.7 to 1.0.

16. A development unit comprising:

a container configured to contain two-component developer including toner particles and carrier beads;

agitating means for agitating and convey the two-component developer in the container;

developer carrying means for picking up the two-component developer from the container and carrying the two-component developer thereon, the developer carrying means having therein a magnetic field generating means including a plurality of fixed magnets and having formed thereon a plurality of grooves with a generally V-like shape and whose depth satisfies $$h \geqq 50 + R/2 + \{(R/2)/\sin(\theta/2)\},$$

in which h represents the depth of the grooves, θ represents an opening angle of the grooves, and R represents a volume-average diameter of the carrier beads; and regulating means extending toward the developer carring means from below the developer carring means, disposed at a predetermined distance from the developer carring means for regulating an amount of the two-component developer carried on the developer carrying means.

* * * * *

UNITED STATES PATENT AND TRADEMARK OFFICE

CERTIFICATE OF CORRECTION

PATENT NO. : 7,466,947 B2
APPLICATION NO. : 11/372142
DATED : December 16, 2008
INVENTOR(S) : Zemba It is certified that error appears in the above-identified patent and that said Letters Patent is hereby corrected as shown below:

On the title page, Item (54), and Column 1, the title should read:

-- (54) APPARATUS FOR FORMING IMAGES, INCLUDING MAGNETIC FIELD GENERATING MEMBER --

Signed and Sealed this

Tenth Day of February, 2009

JOHN DOLL
*Acting Director of the United States Patent and Trademark Office*